United States Patent [19]

Balais

[11] 4,220,144

[45] Sep. 2, 1980

[54] ORAL HYGIENE DEVICE

[76] Inventor: Marcelino P. Balais, 2550 N. Fairhill St., Philadelphia, Pa. 19133

[21] Appl. No.: 969,779

[22] Filed: Dec. 15, 1978

[51] Int. Cl.[3] ..... A61H 7/00

[52] U.S. Cl. ..... 128/62 A

[58] Field of Search ..... 128/62 A, 67; 15/110, 15/244 R; 132/84 R, 85 R, 76.4, 76.5, 75.6

[56] References Cited

U.S. PATENT DOCUMENTS

| | | | |
|---|---|---|---|
| 1,153,409 | 9/1915 | Wheeler | 128/62 A |
| 2,029,031 | 1/1936 | Novick | 15/110 |
| 2,110,315 | 3/1938 | Wolfson | 128/62 A |
| 3,029,809 | 4/1962 | Madlung | 128/62 A |

FOREIGN PATENT DOCUMENTS

| | | | |
|---|---|---|---|
| 1132190 | 10/1956 | France | 128/67 |
| 94359 | 6/1969 | France | 15/110 |
| 169217 | 9/1921 | United Kingdom | 128/62 A |

*Primary Examiner*—Lawrence W. Trapp
*Attorney, Agent, or Firm*—Morton J. Rosenberg

[57] ABSTRACT

An oral hygiene device to be secured to a first end section (16). A gingivae massage element (22) is secured to a second end section (18) of the toothbrush (12). The massage element (22) substantially defines a chordal segment of a cylindrical contour which has an arcuate contour outer surface (24) for compressively interfacing with the gingivae of a user. The gingivae massage element (22) includes a planar chordal surface (26) which is secured to the second end section (18) of the toothbrush (12). In this manner, the gingivae massage element (22) is compressively and deformably pressed against the gingivae lining during a massaging motion with a minimization of the possibility of injury to the tissue through any force application.

7 Claims, 4 Drawing Figures

ORAL HYGIENE DEVICE

BACKGROUND OF THE INVENTION

1. Field of the Invention

This invention pertains to oral hygiene devices. In particular, this invention relates to oral hygiene devices inserted into the oral cavity for compressive interface against the gingivae lining of a user. More in particular, this invention pertains to a predetermined contour of a massage element, which allows compressive interface and deformability when inserted into interfacing contact with the gingivae lining of a user. Still further, this invention relates to an oral hygiene device which may be compressively deformed against the gingivae lining of a user while minimizing the possibility of injury to the tissue.

2. Prior Art

Oral hygiene devices which in combination may be utilized for gum massage are known in the art. The best prior art known to applicant is provided in U.S. Pat. Nos. 1,796,893; 2,253,910; 2,702,914; 2,600,136; 2,110,315; 2,653,598; 3,050,072; 2,888,008; 2,790,441; and, 2,029,031.

In some prior art type devices of this nature, a pointed end section is provided for traversing the gum line or gingivae to dislodge deposits from the gingivae. In such prior art type devices, any pointed end member may cause injury to the tissue with which it interfaces, and thus provides for a distinct disadvantage in the utilization of the device. In other prior art type devices, the gum massage element may be mounted within the bristles of the toothbrush. However, in such types of devices, the bristles may interface with the gingivae lining to cause a harsh rubbing action which may injure the tissue.

In other types of prior art devices, rubber blocks may be provided, however, such does not provide the arcuate contour, having a deformable apex to prevent injury to the tissue while deforming into a maximizing area for contact with surrounding gingivae tissue.

SUMMARY OF THE INVENTION

An oral hygiene device which includes a longitudinally extended toothbrush having bristles secured to a first end section thereof. A gingivae massage element is secured to a second end section of the longitudinally extended toothbrush. The massage element substantially defines a chordal segment of a cylindrical contour, having an arcuate contour outer surface for compressive interface with the gingivae of a user. The gingivae massage element further includes a planar chordal surface secured to the second end section of the toothbrush.

DESCRIPTION OF THE PREFERRED EMBODIMENTS

Figure 1:
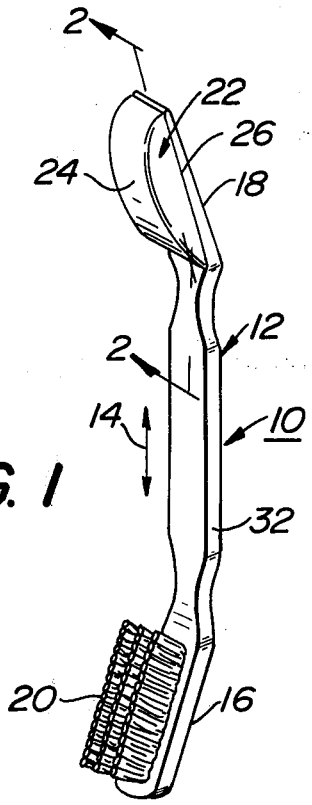
FIG. 1 is a perspective view of the oral hygiene device, shown in a preferred embodiment for utilization with a toothbrush.
Figure 2:
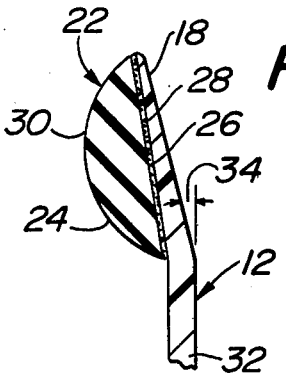
FIG. 2 is a sectional view of the embodiment shown in FIG. 1, taken along the section line 2—2 of FIG. 1.

Referring now to FIGS. 1-2, there is shown oral hygiene device 10 adapted for insert into the mouth of a user utilized for both brushing of the teeth and massaging the gingivae lining within the oral cavity. Oral hygiene device 10 is particularly contoured and formed of a composition which is deformable in nature in order to apply a gentle massaging action to the gingivae lining. The deformable nature of the particular components of oral hygiene device 10 allows for blood stimulation without providing for tissue damage which has been found to occur when a hardened type of element is used in any interface contact with the gum or gingivae lining of a user. The particular geometrical contour of the massaging element of oral hygiene device 10 allows for maximization of the deformation in an apex region upon deformation and maximizes the contact area subsequent to deformation at the contiguous interface of the massaging element and the gingivae lining.

In the preferred embodiment shown in FIGS. 1 and 2, there is shown toothbrush 12 having an extended length in longitudinal direction 14. Toothbrush 12 includes first end section 16 and second end section 18, as shown in FIG. 1. Toothbrush bristles 20 are secured to toothbrush first end section 16 in rigid constrainment therewith, as is generally found in a commercially known type of toothbrush. Toothbrush 12 may be formed of a plastic material well-known in the art, and not the subject of the instant invention concept.

Gingivae massage element 22 is secured to toothbrush second end section 18. Massage element 22 substantially defines a chordal segment of a cylindrical contour, having arcuately contoured outer surface 24 adapted for compressive interface with the gingivae lining of a user. Additionally, gingivae massage element 22 includes planar chordal surface 26 secured to second end section 18 of toothbrush 12.

Gingivae massage element 22 importantly has a composition adapted for compressible deformation when massage element 22 is compressed against the gingivae lining by the user. In particular, gingivae massage element 22 is formed of a soft rubber composition. Still further, massage element 22 has been successfully used when a Latex type composition system is provided for massage element 22.

Chordal planar surface 26 may be rigidly mounted to second end section 18 by adhesive bonding 28 as shown in FIG. 2. In this manner, massage element 22 is rigidly mounted and secured to the overall frame structure of toothbrush 12.

The overall contour of massage element 22 is important in the functional utilization of oral hygiene device 10. Massage element 22 through the cylindrical contour includes apex 30 which due to its low area of contact, easily deforms under a force applied by the user. This deformation essentially spreads out the remaining interface area of contact between gingivae massage element 22 and the gingivae lining. The spreading out or maximizing of the area of interface contact allows the user a wider range of applicable forces, while at the same time, maintaining a gentle massaging action on the gingivae lining. This has the effect of providing circulation of the blood in the area of the gingivae lining, while minimizing any damage which may occur to the tissue upon the applicable force provided by the user.

Toothbrush 12 has a generally extended length in longitudinal direction 14. Toothbrush 12 includes central section 32 which is generally planar in contour and extends in longitudinal direction 14. In order to ease the access to the gingivae lining, second end section 18 forms an inclined angle with longitudinal direction 14, as provided by inclined angle 34. The inclination of second end section 18 with respect to central section 32 has approximately 15°, which has been found to be a substantially optimal type of inclination angle when taken with respect to the ease of use when toothbrush 12 is manually inserted within the oral cavity.

In a similar manner, toothbrush first end section 16 is inclined with respect to the extension length direction of toothbrush central section 32 or longitudinal direction 14. Inclination of toothbrush first end section 16 similarly approximates a 15° inclination angle to provide ease upon the brushing of the teeth of the user.

Gum or gingivae massage element 22 provides for an outer circular contour, having a diameter dimension approximating 1.5 inches. This dimension is important in that massage element 22 must be of an optimal size for insert within the oral cavity of the user, while maintaining a comfort level which is acceptable. Additionally, the extension length of toothbrush second end section 18 is determined by the overall diameter of massage element 22. Still further, the chordal length of planar surface 26 must be sufficient in order that apex 30 be deformed in a manner to increase the contact surface area with the gingivae lining upon compressible insert by the user.

Figure 4:
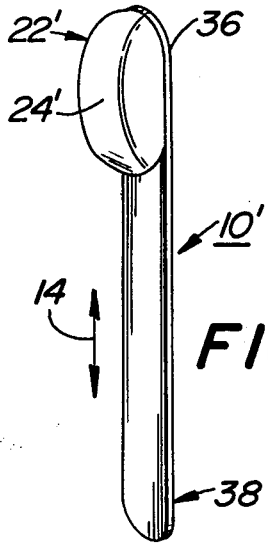

Referring now to FIG. 4, there is shown an embodiment of oral hygiene device 10'. In this embodiment, there is provided gingivae massage element 22' secured to end section 36 of longitudinally extended element 38. In this embodiment, massage element 22' substantially defines chordal segment of the cylindrical contour as has hereinbefore been described. Arcuate contour outer surface 24' compressibly interfaces with the gingivae lining of the user and a planar chordal surface similar to surface 26 of the preferred embodiment is bonded or otherwise securely fastened to end section 36 of longitudinally extended element 38. Longitudinally extended element 38 may be a planar stick member, adapted to be grasped in the hand of a user. Additionally, massage element 22' outer surface 24' in this embodiment, may be provided with an arcuate contour when taken with respect to longitudinal direcion 14, as well as a transverse direction. In this manner, massage element 22' may be formed in a hemisphere type of overall contour.

Figure 3:
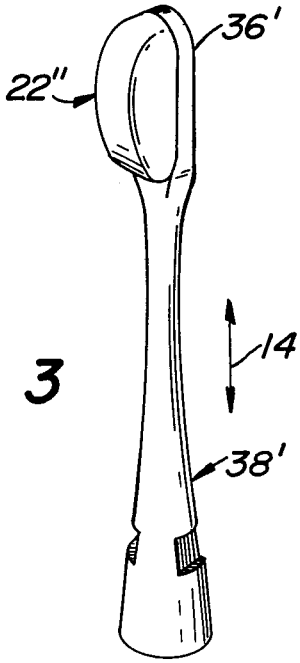
FIG. 3 is an embodiment of the oral hygiene device, shown mounted on an extension member which is adapted for use with automatic toothbrush mechanisms; and, FIG. 4 is another embodiment of the oral hygiene device mounted on a planar type stick member, utilized for manual insert into the oral cavity.

Referring now to FIG. 3, there is shown a further embodiment wherein massage element 22'' is fixedly secured in a manner as has hereinbefore been described, to longitudinally extended element 38'. In this embodiment, longitudinally extended element 38' is generally cylindrical in contour and is an element type well-known for insert into a standard automatic electric toothbrush mechanism. Massage element 22'' is mounted to end section 36' and inserted within the oral cavity of the user in the manner as provided for the embodiments shown in FIGS. 1, 2, 4.

In all of the embodiments shown, the user inserts the end section 18, 36, or 36' into the oral cavity and compresses massage element 22, 22', or 22'' against the gingivae lining. The user then massages various areas of the gingivae lining in order to provide the mode of operation to circulate the blood and minimize any damage to the tissue through force application.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. An oral hygiene device, comprising:

(a) a longitudinally extended toothbrush having bristles secured to a first end section thereof; and, (b) a gingivae massage element secured to a second end section of said longitudinally extended toothbrush, said massage element substantially defining a chordal segment of a cylindrical contour having an arcuate contour outer surface for compressive interface with the gingivae of a user and a planar chordal surface secured to said second end section of said toothbrush, said gingivae massage element being adhesively bonded to said second end section of said toothbrush throughout said planar chordal surface of said massage element.

2. The oral hygiene device as recited in claim 1 wherein said gingivae massage element composition is adapted for comprehensible deformation when said message element is compressed against said gingivae.

3. The oral hygiene device as recited in claim 2 where said hygiene massage element is formed of a soft rubber composition.

4. The oral hygiene device as recited in claim 3 where said gingivae massage element is formed of a latex composition.

5. The oral hygiene device as recited in claim 1 where said arcuate surface of said gingivae massage element includes a diameter dimension approximating 1.5 inches.

6. The oral hygiene device as recited in claim 1 where said toothbrush second end section is inclined to said longitudinal extension direction, said inclination forming an angle approximating 15° with respect to said longitudinal direction.

7. The oral hygiene device as recited in claim 6 where said toothbrush first end section is inclined to said longitudinal extension direction, said inclination forming an angle approximating 15° with respect to said longitudinal direction.

* * * * *